US010946660B2

(12) United States Patent
Ueda et al.

(10) Patent No.: US 10,946,660 B2
(45) Date of Patent: Mar. 16, 2021

(54) LIQUID DISCHARGE APPARATUS AND SUCTION APPARATUS

(71) Applicants: Shotaro Ueda, Tokyo (JP); Shingo Masaoka, Kanagawa (JP); Isamu Kubo, Kanagawa (JP)

(72) Inventors: Shotaro Ueda, Tokyo (JP); Shingo Masaoka, Kanagawa (JP); Isamu Kubo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/480,437

(22) PCT Filed: Mar. 2, 2018

(86) PCT No.: PCT/JP2018/007969
§ 371 (c)(1),
(2) Date: Jul. 24, 2019

(87) PCT Pub. No.: WO2018/168517
PCT Pub. Date: Sep. 20, 2018

(65) Prior Publication Data

US 2019/0381798 A1 Dec. 19, 2019

(30) Foreign Application Priority Data

Mar. 17, 2017 (JP) ..... JP2017-052436
Jan. 19, 2018 (JP) ..... JP2018-007492

(51) Int. Cl.
*B41J 2/165* (2006.01)
*B41J 2/335* (2006.01)

(52) U.S. Cl.
CPC ..... *B41J 2/16508* (2013.01); *B41J 2/1652* (2013.01); *B41J 2/335* (2013.01)

(58) Field of Classification Search
CPC . B41J 2/16508; B41J 2/16511; B41J 2/16523
See application file for complete search history.

(56) References Cited

U.S. PATENT DOCUMENTS 6,918,650 B2 * 7/2005 Umeda ..... B41J 2/16508 347/29
2002/0075348 A1 6/2002 Shindo
(Continued)

FOREIGN PATENT DOCUMENTS

CN 1473709 A 2/2004
JP 10-264402 A 10/1998
(Continued)

OTHER PUBLICATIONS

International Search Report and Written Opinion dated Jun. 7, 2018 in PCT/JP2018/007969 filed on Mar. 2, 2018.
(Continued)

*Primary Examiner* — Lam S Nguyen
(74) *Attorney, Agent, or Firm* — Oblon, McClelland, Maier & Neustadt, L.L.P.

(57) ABSTRACT

An object of the present disclosure is to provide a liquid discharge apparatus capable of sucking liquid in a cap member while suppressing generation of bubbles by a suction assisting member detachable from a cap member. A liquid discharge apparatus includes a liquid discharge head (6) to discharge liquid from a plurality of nozzles, and a suction mechanism (8) to suck the liquid from the liquid discharge head (6). The suction mechanism (8) includes a cap member (30) to contact the liquid discharge head (6) and cover the plurality of nozzles while forming a space between the cap member (30) and the liquid discharge head (6), a suction pump (31) connected to the cap member (30) via a suction hole (31*a*) formed in a surface of the cap member (30) to reduce pressure in the space, a suction assisting member (32) to cover the suction hole (30*a*) and the surface in which the suction hole (30*a*) is formed in the cap member (30), the suction assisting member (32) including a surface that forms a suction path between the suction assisting member (32) and the cap member (30), and a first support
(Continued)

(32*a*) to provide a gap (c1) between the surface that forms the suction path of the suction assisting member (32) and the surface in which the suction hole (31*a*) is formed.

10 Claims, 12 Drawing Sheets

(56) References Cited

U.S. PATENT DOCUMENTS

| | | | |
|---|---|---|---|
| 2004/0155920 | A1 | 8/2004 | Umeda |
| 2007/0139464 | A1 | 6/2007 | Suzuki |
| 2007/0247492 | A1 | 10/2007 | Mori |
| 2008/0204505 | A1 | 8/2008 | Kubo |
| 2008/0218564 | A1 | 9/2008 | Kubo |
| 2009/0122122 | A1 | 5/2009 | Kubo et al. |
| 2010/0002048 | A1 | 1/2010 | Masaoka |
| 2010/0020128 | A1 | 1/2010 | Kubo |
| 2010/0194819 | A1 | 8/2010 | Tamaki |
| 2010/0321426 | A1 | 12/2010 | Suzuki et al. |
| 2011/0273511 | A1 | 11/2011 | Yanase et al. |
| 2014/0098159 | A1 | 4/2014 | Miwa et al. |
| 2014/0253626 | A1 | 9/2014 | Masaoka et al. |
| 2015/0062223 | A1 | 3/2015 | Takeuchi et al. |
| 2015/0097894 | A1 | 4/2015 | Masaoka et al. |
| 2016/0325550 | A1 | 11/2016 | Masaoka et al. |
| 2017/0165970 | A1 | 6/2017 | Yokoyama et al. |

FOREIGN PATENT DOCUMENTS

| | | |
|---|---|---|
| JP | 11-058753 | 3/1999 |
| JP | 3255528 B2 | 2/2002 |
| JP | 2006-051808 | 2/2006 |
| JP | 2007-090807 | 4/2007 |

OTHER PUBLICATIONS

Chinese Office Action and Search Report dated Jul. 15, 2020 in Chinese Patent Application No. 201880018558.9, 6 pages.

* cited by examiner

LIQUID DISCHARGE APPARATUS AND SUCTION APPARATUS

TECHNICAL FIELD

Aspects of the present disclosure relate to a liquid discharge apparatus and a suction apparatus.

BACKGROUND ART

As a liquid discharger, such as a printer, a facsimile machine, a plotter, or a multi-function machine including these functions, an image forming apparatus (inkjet recording apparatus) using a liquid discharge head (droplet discharge head) that discharges ink droplets (liquid droplets) is known.

Further, the inkjet recording apparatus includes a suction mechanism for sucking liquid from the liquid discharge head. The suction mechanism caps and seals a nozzle surface of the liquid discharge head and sucks and discharges the ink from the nozzles by the negative pressure of a suction pump to prevent the nozzles from clogging (cleaning operation) when clogging or the like occurs in the nozzles of the liquid discharge head.

However, when the ink inside the cap is suctioned to remove the ink in the cap, the bubbles of the ink may remain in the cap. If a nozzle surface of the liquid discharge head is capped with the cap while the bubbles remaining in the cap, the bubbles may come into contact with the nozzle surface of the liquid discharge head. The bubbles on the nozzle surface may cause printing defects such as color mixing and missing dots (nozzles). In order to prevent generation of the bubbles in the ink, a technique of providing an absorber inside the cap is known.

For example, PTL 1 discloses a purge mechanism including a cap having a lip portion and a support for preventing the lip portion from falling inward. An inclined surface is formed in the lip portion for supporting the lip portion from a suction pressure. This purge mechanism aims to improve an ink absorption efficiency in the cap by appropriate maintenance of a state of contact between the nozzle surface of the liquid discharge head and the cap.

CITATION LIST

Patent Literature

PTL 1: Japanese Unexamined Patent Application Publication No. 2007-090807

SUMMARY OF INVENTION

Technical Problem

However, the configuration in which the absorber is provided in the conventional cap may not sufficiently prevent generation of bubbles when ink is used that has a high viscosity and adheres when dried. Thus, the user has to clean the interior of the cap. However, it is difficult to clean and exchange the absorber because the absorber is fixed to the cap with an adhesive. If a holding mechanism that fixes the absorber to the cap is used separately without using the adhesive, the number of parts of the cap increases as does its cost.

It is therefore an object of the present invention to provide a liquid discharge apparatus capable of sucking liquid in a cap while suppressing generation of bubbles using a suction assisting member.

Solution to Problem

In an aspect of the present disclosure, a novel liquid discharge apparatus is provided that includes a liquid discharge head to discharge liquid from a plurality of nozzles, and a suction mechanism to suck the liquid from the liquid discharge head. The suction mechanism includes a cap member to contact the liquid discharge head and cover the plurality of nozzles while forming a space between the cap member and the liquid discharge head, a suction pump connected to the cap member via a suction hole formed in a surface of the cap member to reduce pressure in the space, and a suction assisting member to cover the suction hole and the surface in which the suction hole is formed in the cap member. The suction assisting member has a surface that forms a suction path between the suction assisting member and the cap member. A first support provides a gap between the surface that forms the suction path of the suction assisting member and the surface in which the suction hole is formed.

Advantageous Effects of Invention

The liquid discharge apparatus according to the present embodiment includes a gap between a surface forming a suction path of a suction assisting member and a surface on which a suction hole is formed in the cap member. Thus, it is possible to suck the liquid in the cap member while preventing the generation of bubbles.

DESCRIPTION OF EMBODIMENTS

An embodiment is described below with reference to the drawings.

Figure 1:
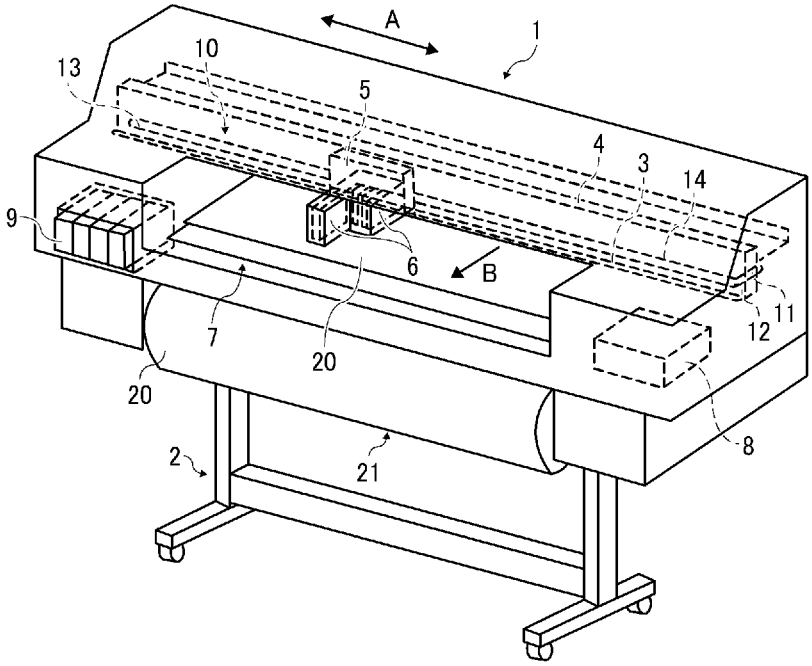
FIG. 1 is a perspective view illustrating an overall configuration of a liquid discharge apparatus according to a first embodiment of the present disclosure.
Figure 2:
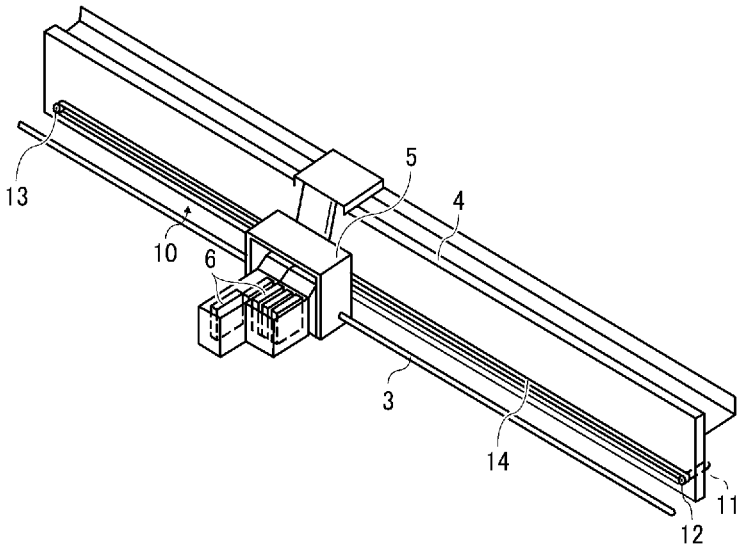
FIG. 2 is a perspective view of a carriage scanning mechanism according to the first embodiment of the present disclosure.

FIG. 1 is a schematic perspective view illustrating an overall configuration of a liquid discharge apparatus according to a first embodiment of the present disclosure. FIG. 2 is a perspective view of a carriage scanning mechanism.

As illustrated in FIG. 1, this liquid discharge apparatus is a serial type inkjet recording apparatus, and includes an apparatus body 1 and a support base 2 for supporting the apparatus body 1. The guide rod 3 and the guide stay 4 are bridged between side plates in the apparatus body 1. The guide rod 3 and the guide stay 4 serve as a guide member. A carriage 5 is supported by the guide rod 3 and the guide stay 4 so that the carriage 5 can move in a direction indicated by arrow A (main scanning direction).

The carriage 5 mounts recording heads 6 configured by liquid discharge heads for discharging ink droplets of each colors of black (K), yellow (Y), magenta (M), and cyan (C). Each recording heads 6 includes multiple nozzles to discharge the liquid droplets. Each recording heads 6 integrally includes a head tank for supplying ink to the corresponding recording head 6.

A main scanning mechanism 10 moves and scans the carriage 5. The main scanning mechanism 10 includes a drive motor 11, a drive pulley 12, a driven pulley 13, and a timing belt 14. The drive motor 11 is disposed on one side in the main scanning direction. The drive pulley 12 is rotary-driven by the drive motor 11. The driven pulley 13 is disposed on the other side in the main scanning direction. The timing belt 14 is a towing member stretched between the drive pulley 12 and the driven pulley 13. The driven pulley 13 is pulled by a tension spring in a direction away from the drive pulley 12.

A sheet 20 is intermittently conveyed by a suction conveyor in a direction indicated by arrow B (sub-scanning direction, sheet conveyance direction) perpendicular to the main scanning direction of the carriage 5 in a recording area of a main scanning area of  the carriage 5.

In one of an end side area of the main scanning area, a suction mechanism 8 is disposed for suctioning the liquid from the recording head 6. Further, main cartridges 9 are detachably mounted on the apparatus body 1 on an area outside the carriage moving area in the main scanning direction or on another end side area of the main scanning area. The main cartridges 9 store respective colors of inks to be supplied to the sub tanks of the recording heads 6. Further, although a roll sheet (hereinafter referred to as "sheet 20") is set in a feeder 21, the roll sheet having different sizes in the width direction can also be set on the feeder 21.

In the liquid discharge apparatus configured as described above, image formation is performed as follows. First, the sheet 20 conveyed from the feeder 21 is conveyed to the recording area by a conveyor from a rear side to a front side of the apparatus body 1. Next, a required image is formed on the sheet 20 by discharging liquid droplets by the recording head 6 driven according to image information while the carriage 5 is moved in the main scanning direction and the sheet 20 is intermittently fed to the platen 7 by the suction conveyor. The sheet 20 after image formation is cut to a predetermined length and discharged to an ejection tray disposed on the front side of the apparatus body 1.

Although the configuration in which the sheet 20 is cut and ejected is described here, it is also possible to adopt a configuration in which the sheet after image formation is wound by an ejector without cutting.

Next, a configuration of the suction mechanism for sucking liquid from the recording head is described below in detail. The suction mechanism is a characteristic part of the present embodiment.

Figure 3:
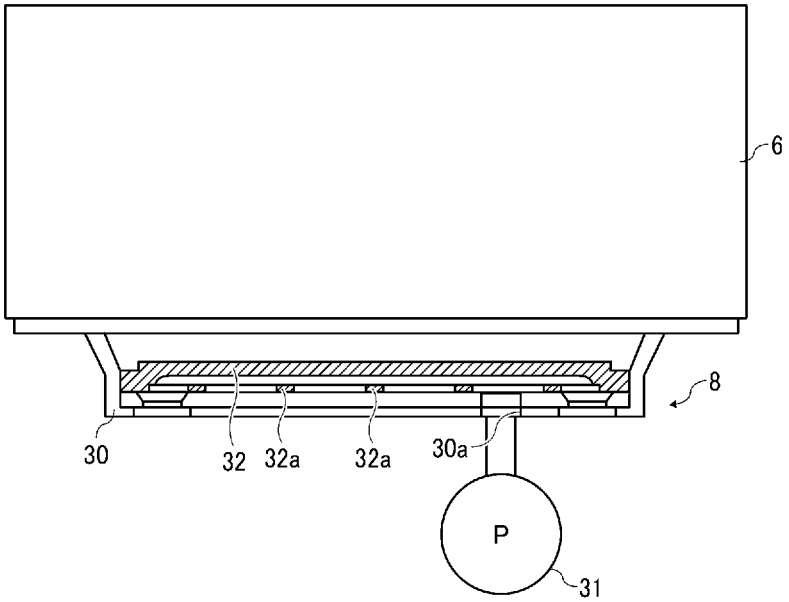
FIG. 3 is a front view of an overall configuration of a suction mechanism according to the first embodiment of the present disclosure.

FIG. 3 is a front view of an overall configuration of a suction mechanism according to a first embodiment of the present disclosure. As illustrated in FIG. 3, the suction mechanism 8 includes a cap member 30, a suction pump 31, and a suction assisting member 32.

The cap member 30 is made of an elastic material such as rubber. The cap member 30 contacts the recording head 6 and forms a space between the cap member 30 and the recording head 6 while covering a nozzle surface of the recording head 6 in an airtight manner. Therefore, the nozzle surface is moisturized and protected. Further, an interior of the cap member 30 can also be filled with a liquid (ink). Further, a suction hole 30*a* is formed in one surface (lower surface) of the cap member 30.

The suction pump 31 is connected to the cap member 30 via the suction hole 30*a* so that the suction pump 31 can suck gas or liquid in the cap member 30. Therefore, it is possible to suck the liquid (ink) accumulated inside the cap member 30 or to lower pressure in the space between the cap member 30 and the recording head 6.

The suction assisting member 32 inside the cap member 30 has a surface that covers the suction hole 30*a* of the cap member 30 and a surface (lower surface) in which the suction hole 30*a* is formed. Further, the surface of the suction assisting member 32 forms a suction path.

Figure 4A:
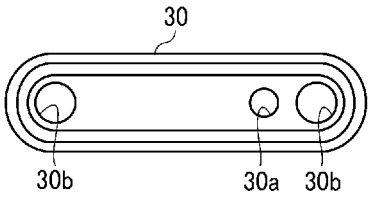
FIG. 4A is a plan view of a cap member according to a first embodiment of the present disclosure.
Figure 4B:
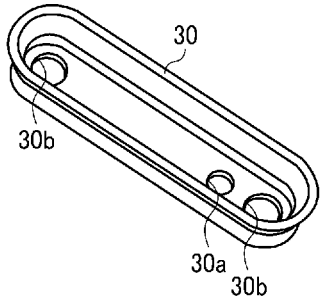
FIG. 4B is a perspective view of the cap member.

FIG. 4A is a plan view of the cap member according to a first embodiment of the present disclosure. FIG. 4B is a perspective view of the cap member. As illustrated in FIGS. 4A and 4B, screw holes 30*b* are provided at both end portions of the cap member 30, and a suction hole 30*a* is provided between the screw holes 30*b*.

Figure 5:
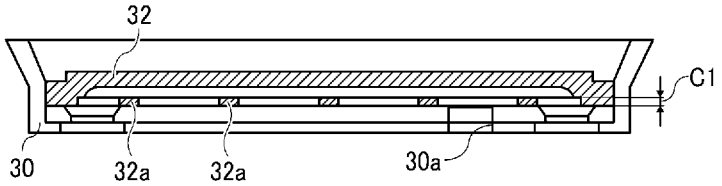
FIG. 5 is a front view of the cap member and a suction assisting member according to the first embodiment of the present disclosure.

FIG. 5 is a front view of the cap member and the suction assisting member according to the first embodiment of the present disclosure. As illustrated in FIG. 5, the cap member 30 has a shape expanding upward and includes the suction hole 30*a* having a diameter of about 3.0 mm on a bottom face of the cap member 30.

In addition, the suction assisting member 32 includes a plurality of supports 32*a* having a height of about 0.5 mm. A gap (C1) is provided between the surface that forms the suction path of the suction assisting member 32 and the surface in which the suction hole 30*a* of the cap member 30 is formed. As a result, the liquid (ink) in the cap member 30 can be sucked uniformly from a circumference of the suction assisting member 32 by the suction pump 31 along an inner wall of the cap member 30. The plurality of supports 32*a* is one example of a first support.

Figure 6:
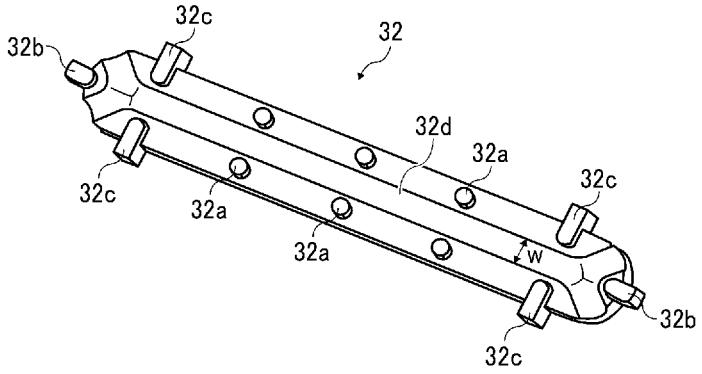
FIG. 6 is a perspective view illustrating a shape of the suction assisting member according to the first embodiment of the present disclosure.

FIG. 6 is a perspective view of the suction assisting member according to the first embodiment of the present disclosure, illustrating a shape of the suction assisting member. As illustrated in FIG. 6, short-side projections 32*b* are provided at both ends in a longitudinal direction of the suction assisting member 32, and long-side projections 32*c* are provided at two places on both sides in the short-side direction. The short-side projections 32*b* protrude by about 1.5 mm outside in the longitudinal direction. The long-side projections 32*c* also protrude by about 1.5 mm outside in the short-side direction. The short-side projections 32*b* and the long-side projections 32*c* have a height of about 1.0 mm. The short-side projections 32*b* and the long-side projections 32*c* are an example of a second support.

A groove portion 32*d* extending in the longitudinal direction of the cap member 30 is formed in a central portion of the suction assisting member 32 on a surface facing the suction hole 30*a* of the cap member 30. This groove portion 32*d* has a semicircular cross-section with a radius of about 0.75 mm and is bifurcated at both end portions in the longitudinal direction of the cap member 30. Then, the ink flows into a portion including the groove portion 32*d* through a circumferential portion other than the supports 32*a* and the both ends in the longitudinal direction of the cap member 30 at which the groove portion 32*d* is bifurcated.

If the longitudinal direction of the cap member 30 is elongated with an upsizing of the recording head 6 (liquid discharge head), a suction force of the suction pump 31 acts on the gap (C1) around the suction hole 30*a*. However, the suction force of the suction pump 31 does not reach the side away from the suction hole 30*a*. Therefore, liquid or bubbles may remain. Therefore, the present embodiment includes the groove portion 32*d* that increases a cross-sectional area of  the suction assisting member 32 and lowers fluid resistance. Thus, it is possible to exert the suction force on the side away from the suction hole 30*a* and to suck liquid or bubbles without leaving liquid or bubbles in the cap member.

A width (w) of the groove portion 32*d* in the short-side direction of the cap member 30 is preferably smaller than a maximum width of the suction hole 30*a* in the short-side direction of the cap member 30. As a result, the suction hole 30*a* faces not only the groove portion 32*d* but also a region where the plurality of supports 32*a* are formed around the groove portion 32*d*. Therefore, the suction force of the suction pump 31 can be uniformly applied to the groove portion 32*d* (the longitudinal-direction of the cap member 30) and the circumferential portion (the short-side direction of the cap member 30). Here, the plurality of supports 32*a* provided along the groove portion 32*d* has already been described above.

The suction assisting member 32 is made of a material having a higher rigidity than the cap member 30 has. The suction assisting member 32 is formed of, for example, a synthetic resin (plastic) having a higher rigidity than a rigidity of the cap member 30 made of rubber. As illustrated in FIG. 5, the suction assisting member 32 is press fitable into the cap member 30. Then, the short-side projections 32*b* press the inner wall (short-side) of the cap member 30, and the long-side projections 32*c* press the inner wall (longitudinal-side) of the cap member 30, respectively. Therefore, the cap member 30 is elastically deformed, and the suction assisting member 32 is fixed to the cap member 30. Here, an adhesive or the like is not used for fixing the suction assisting member 32 to the cap member 30. Thus, the suction assisting member 32 can be taken out (is detachable) from the cap member 30.

Figure 7:
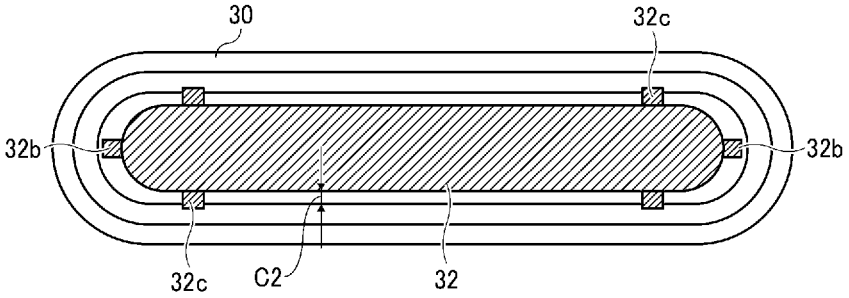
FIG. 7 is a plan view of the suction assisting member attached to the cap member as viewed from above.

FIG. 7 is a plan view of the suction assisting member attached to the cap member as viewed from above. As illustrated in FIG. 7, a gap (C2) about 1.0 mm is formed between an inner circumferential surface of the cap member 30 and the surface forming the suction path of the suction assisting member 32 by the second support (the short-side projections 32*b* and the long-side projections 32*c*). In this way, providing a gap between the circumference of the suction assisting member 32 and the inner wall of the cap member 30, liquid (ink) can be sucked along the inner wall of the cap member 30.

Figure 8A:
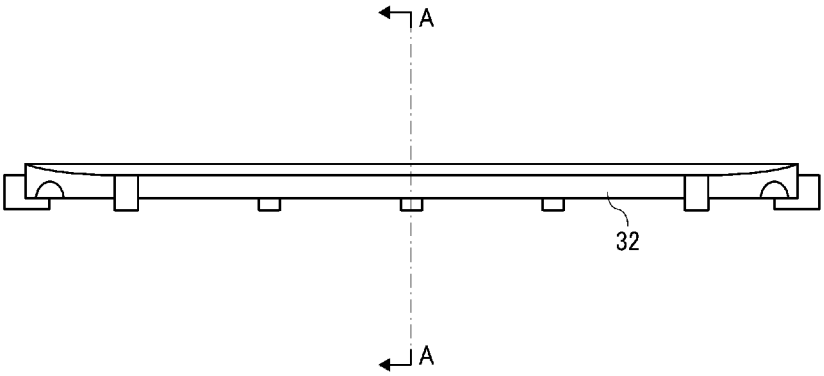
FIG. 8A is a plan view of the suction assisting member.
Figure 8B:
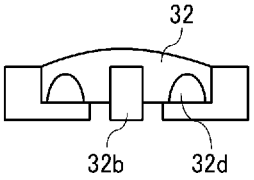
FIG. 8B is a cross-sectional view in a short-side direction of FIG. 8A.
Figure 8C:
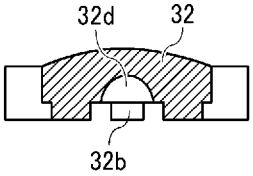
FIG. 8C is a cross-sectional view along a line A-A in FIG. 8A.

FIG. 8A is a plan view of the suction assisting member. FIG. 8B is a side view in the short-side direction of FIG. 8A. FIG. 8C is a cross-sectional view along a line A-A in FIG. 8A.

FIG. 8B illustrates the suction assisting member 32 from a side face. A square in a center of FIG. 8B illustrates the short-side projection 32*b*, and the hemispheres on both sides of the square illustrates a Y-shaped portion of the groove portion 32*d*. FIG. 8C is a cross-sectional view of the suction assisting member 32. A square at the center indicates the short-side projection 32*b*, and the hemisphere above the square illustrates the groove portion 32*d*.

As illustrated in FIGS. 8B and 8C, an upper portion (a surface facing the recording head 6) of the suction assisting member 32 is curved convexly at a center portion in the short-direction of the suction assisting member 32. That is, the upper portion of the suction assisting member 32 is inclined such that the center portion is the highest and gradually decreases toward the circumferences of the suction assisting member 32. As a result, the liquid (ink) does not stay at the upper portion of the suction assisting member 32 and flows to the circumferences of the suction assisting member. Thus, it is possible to prevent the liquid (ink) to be remained after sucking process.

As described above, the liquid discharge apparatus of the present embodiment includes the gap (C1) between the surface forming the suction path of the suction assisting member 32 and the surface forming the suction hole 30*a* of the cap member 30 by the first support (See FIG. 5). Further, the gap (C2) is provided between the surface forming the suction path of the suction assisting member 32 and the inner circumferential surface of the cap member 30 by the second support (see FIG. 7). Therefore, the suction pump 31 can suck liquid (ink) from the entire area along the inner circumference of the cap member 30. Thus, the suction pump 31 can suck liquid (ink) in the cap member 30 while preventing generation of bubbles.

Further, the suction assisting member 32 of the liquid discharge apparatus according to the present embodiment can press the cap member 30 to be fixed to the cap member 30 by the second supports (the short-side projections 32*b* and the long-side projections 32*c*). Thus, the suction assisting member 32 is easily detachable from the cap member 30. Therefore, the present embodiment enables an exchange and cleaning of the suction assisting member by the user. Further, the suction assisting member is constructed inexpensively since the suction assisting member does not use a separate holding mechanism.

In the present embodiment, the cap member 30 is formed of an elastic material, and the suction assisting member 32 is formed of a material having a higher rigidity than a rigidity of the cap member 30. However, the present embodiment is not limited to the embodiments described above. The suction assisting member 32 may be formed of an elastic material and the cap member 30 may be formed of a material having a higher rigidity than a rigidity of the suction assisting member 32.

Figure 9:
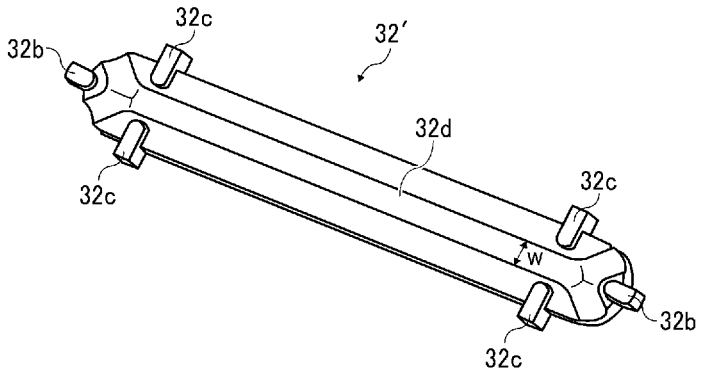
FIG. 9 illustrates a shape of the suction assisting member without supports.

In addition, although the suction assisting member 32 includes a plurality of supports 32*a* (formed together with the suction assisting member 32 as a single body), the present embodiment is not limited to including the plurality of supports 32*a*. FIG. 9 illustrates a shape of the suction assisting member without the supports. This suction assisting member 32' is the same as the suction assisting member 32 illustrated in FIG. 6, except that the support 32*a* is not provided on the suction assisting member 32'. In this case, the cap member 30 may include a plurality of supports 32*a*, or a plurality of supports 32*a* may be provided separately with the cap member 30.

Variation

The suction mechanism of the liquid discharge apparatus is described above. In addition to the liquid discharge apparatus, the suction mechanism may be used for other purposes such as industrial use and medical use. In case the suction mechanism is used for other purposes, the suction apparatus may include a cap member that contacts the suction target surface, forms a space between the suction target surface and cap member, and covers the suction target surface. Other configurations (the suction pump, the suction assisting member, the first support, and the second support) may be used by suitably changing the suction mechanism described above.

Next, clear definitions of terms used in the present embodiment are given.

The term "liquid discharge apparatus" used herein is an apparatus including the liquid discharge head or the liquid discharge device to discharge liquid by driving the liquid discharge head. The liquid discharge apparatus may be, for example, an apparatus capable of discharging liquid to a material to which liquid can adhere, and an apparatus to discharge liquid toward gas or into liquid.

The "liquid discharge apparatus" may include devices to feed, convey, and eject the material on which liquid can adhere. The liquid discharge apparatus may further include a pretreatment apparatus and a post-treatment apparatus.

The "liquid discharge apparatus" may be, for example, an image forming apparatus to form an image on a sheet by discharging ink, or a solid fabrication apparatus (three-dimensional fabricating apparatus) to discharge a fabrication liquid to a powder layer in which powder material is formed in layers, so as to form a solid fabrication object (three-dimensional fabrication object).

In addition, "the liquid discharge apparatus" is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "medium on which liquid can be adhered" include recording media, such as paper sheet, recording paper, recording sheet of paper, film, and cloth, electronic component, such as electronic substrate and piezoelectric element, and media, such as powder layer, organ model, and testing cell. The "medium on which liquid can be adhered" includes any medium on which liquid is adhered, unless particularly limited.

Examples of the material on which liquid can be adhered include any materials on which liquid can be adhered even temporarily, such as paper, thread, fiber, fabric, leather, metal, plastic, glass, wood, ceramic, construction materials (e.g., wall paper or floor material), and cloth textile.

Examples of the liquid are, e.g., ink, treatment liquid, DNA sample, resist, pattern material, binder, fabrication liquid, or solution and dispersion liquid including amino acid, protein, or calcium.

"The liquid discharge apparatus" may be an apparatus to relatively move a liquid discharge head and a medium on which liquid can be adhered. However, the liquid discharge apparatus is not limited to such an apparatus. For example, the liquid discharge apparatus may be a serial type apparatus that moves the liquid discharge head or a line-type apparatus that does not move the liquid discharge head.

Examples of the "liquid discharge apparatus" further include a treatment liquid coating apparatus to discharge a treatment liquid to a sheet surface to coat the sheet surface with the treatment liquid to reform the sheet surface and an injection granulation apparatus to discharge a composition liquid including a raw material dispersed in a solution from a nozzle to mold particles of the raw material.

The liquid discharge device is an integrated unit including the liquid discharge head and functional parts or mechanisms, and is an assembly of parts relating to liquid discharge. For example, "the liquid discharge device" may be a combination of the liquid discharge head with at least one of a head tank, a carriage, a supply unit, a maintenance unit, and a main scan moving unit.

Herein, the terms "integrated" or "united" mean fixing the liquid discharge head and the functional parts or mechanism to each other by fastening, screwing, binding, or engaging and holding one of the liquid discharge head and the functional parts movably relative to the other. The liquid discharge head may be detachably attached to the functional parts or mechanisms each other.

The main scan moving unit may be a guide only. The supply unit may be a tube(s) only or a mount part (loading unit) only.

In addition, "the liquid discharging head" has no specific limit to the pressure generating device used in the liquid discharge head. For example, other than the piezoelectric actuator (may use a laminate-type piezoelectric element) in the embodiments described above, it is possible to use a thermal actuator using the thermoelectric conversion element such as a heat element and an electrostatic actuator including a vibration plate and a counter electrode.

The terms "image formation", "recording", "printing", "image printing", and "fabricating" used herein may be used synonymously with each other.

In the present embodiment, "sheet" is not limited to paper materially, but includes transparent sheets, cloth, glass, substrates, others to which ink droplets and other liquid can be attached, and articles referred to as a recording medium, a recording sheet, recording paper, etc. The terms "image formation", "recording", "printing", and "image printing" used herein may be used synonymously with each another.

The term "ink" is not limited to "ink" in a narrow sense, unless specified, but is used as a generic term for all types of liquid usable as targets of image formation such as recording liquid, fixing solution, and liquid. For example, the term "ink" also includes DNA sample, resist, pattern material, resin, and so on.

The term "image" used herein is not limited to a two-dimensional image and includes, for example, an image applied to a three dimensional object and a three dimensional object itself formed as a three-dimensionally molded image.

The term "image forming apparatus", unless specified, also includes both serial type image forming apparatus and line-type image forming apparatus.

The present embodiment is described in detail using the embodiments. The embodiments described above are merely examples, various modifications and substitutions may be made to the above-described embodiments without departing from the scope described in the appended claims.

REFERENCE SIGNS LIST

1 apparatus body
2 support base
3 guide rod
4 guide stay
5 carriage
6 recording head

7 platen
8 suction mechanism
9 main cartridge
10 main scanning mechanism
11 drive motor
12 drive pulley
13 driven pulley
14 timing belt
20 sheet
21 feeder
30 cap member
30*a* suction hole
30*b* screw hole
31 suction pump
32, 32' suction assisting member
32*a* support
32*b* short-side projection
32*c* long-side projection
32*d* groove portion

The invention claimed is:

1. A liquid discharge apparatus comprising:

a liquid discharge head to discharge liquid from a plurality of nozzles; and a suction mechanism to suck the liquid from the liquid discharge head, wherein the suction mechanism includes:

a cap member to contact the liquid discharge head and cover the plurality of nozzles while forming a space between the cap member and the liquid discharge head;

a suction pump connected to the cap member via a suction hole formed in a surface of the cap member to reduce pressure in the space;

a suction assisting member to cover the suction hole and the surface in which the suction hole is formed in the cap member, the suction assisting member including a surface that forms a suction path between the suction assisting member and the cap member; and a first support to provide a gap between the surface that forms the suction path of the suction assisting member and the surface in which the suction hole is formed, wherein the suction assisting member includes a groove portion formed in a surface facing the suction hole, the groove portion extending in a direction along a longitudinal direction of the cap member, and the groove portion is bifurcated at end portions in a longitudinal direction of the suction assisting member.

2. The liquid discharge apparatus according to claim 1, wherein the suction assisting member is detachable from the cap member.

3. The liquid discharge apparatus according to claim 1, wherein the suction assisting member and the first support form a single integrated unit.

4. The liquid discharge apparatus according to claim 1, wherein a width of the groove portion in a short-side direction of the cap member is smaller than a minimum width of the suction hole in the short-side direction of the cap member.

5. The liquid discharge apparatus according to claim 1, wherein the suction assisting member includes a second support that provides a gap between the surface that forms the suction path of the suction assisting member and an inner circumferential surface of the cap member.

6. The liquid discharge apparatus according to claim 1, wherein at least one of the suction assisting member and the cap member is formed of an elastic material, and the suction assisting member is adapted to fit into the cap member.

7. The liquid discharge apparatus according to claim 5, wherein at least one of the suction assisting member and the cap member is formed of an elastic material, and the suction assisting member is fixed to the cap member by pressing the second support into the cap member.

8. The liquid discharge apparatus according to claim 1, wherein a surface facing the liquid discharge head of the suction assisting member including a central portion curved convexly in the short-side direction of the cap member.

9. A suction apparatus comprising:

a cap member to contact a suction target surface and covers the suction target surface while forming a space between the cap member and the suction target surface;

a suction pump connected to a suction hole formed in a surface of the cap member to reduce pressure in the space;

a suction assisting member to cover the suction hole and the surface in which the suction hole is formed in the cap member, the suction assisting member including a surface that forms a suction path; and a support to provide a gap between the surface that forms the suction path of the suction assisting member and the surface in which the suction hole is formed, wherein the suction assisting member includes a groove portion formed in a surface facing the suction hole, the groove portion extending, in a direction along a longitudinal direction of the cap member, and the groove portion is bifurcated at end portions in a longitudinal direction of the suction assisting member.

10. The suction apparatus according to claim 9, wherein the suction assisting member is detachable from the cap member.

* * * * *